US005203185A

United States Patent [19]

Okuno

[11] Patent Number: 5,203,185

[45] Date of Patent: Apr. 20, 1993

[54] FABRIC CONNECTING METHOD AND FABRIC HAVING CONNECTIONS

[75] Inventor: Masao Okuno, Wakayama, Japan

[73] Assignee: Shima Seiki Mfg. Ltd., Wakayama, Japan

[21] Appl. No.: 709,493

[22] Filed: Jun. 3, 1991

[30] Foreign Application Priority Data

Jun. 5, 1990 [JP] Japan ..... 2-147559

[51] Int. Cl.[5] ..... D04B 7/30

[52] U.S. Cl. ..... 66/171; 66/69

[58] Field of Search ..... 66/69, 70, 75.1, 171, 66/175, 176, 179, 182, 189, 195, 196, 198, 199

[56] References Cited

U.S. PATENT DOCUMENTS

| | | | |
|---|---|---|---|
| 943,921 | 12/1909 | Dubied et al. | 66/69 |
| 3,052,108 | 9/1962 | Lumsden | 66/69 |
| 3,474,643 | 10/1969 | Robinson et al. | 66/189 |
| 3,664,156 | 5/1972 | Betts et al. | 66/176 |
| 3,668,901 | 6/1972 | Betts et al. | 66/176 |
| 3,824,810 | 7/1974 | Betts et al. | 66/176 X |
| 4,094,171 | 6/1978 | Robinson | 66/176 |

FOREIGN PATENT DOCUMENTS

| | | | |
|---|---|---|---|
| 2502574 | 7/1975 | Fed. Rep. of Germany | 66/171 |
| 2183264 | 6/1987 | United Kingdom | 66/176 |

*Primary Examiner*—Clifford D. Crowder
*Assistant Examiner*—John J. Calvert
*Attorney, Agent, or Firm*—Spensley Horn Jubas and Lubitz

[57] ABSTRACT

A beautiful finished fabric of high quality wherein stitch loops of a connection are not bent opposedly to each other, and a method for producing such fabric. By using a flat knitting machine having needle beds arranged in a pair in front and in the rear, parts constituting an article of clothing are knitted separately and connected to a part on the other side. Stitch loops located on the outermost boundary side of one-side part are overlapped with stitch loops of one of second to fourth wales from the boundary side of the other-side part.

9 Claims, 10 Drawing Sheets

FABRIC CONNECTING METHOD AND FABRIC HAVING CONNECTIONS

Field of the Invention

The present invention relates to a fabric connecting method which is carried out by using a flat knitting machine, as well as a fabric produced by the connecting method and having beautiful connections.

RELATED ART STATEMENT

Parts such as the sleeves and body which constitute an article of clothing may be knitted by a flat knitting machine. The by knitted parts then go through a sewing process to form a clothing product.

However, with a view to simplifying or omitting the sewing process whose improvement is strongly demanded in point of working efficiency, the parts of a clothing article are connected together during knitting on a flat knitting machine to save labor of the sewing work which follows the knitting work, and obtain a clothing product of higher quality. More particularly, sleeve and body portions are knitted up to an armpit portion, using needles implanted in needle beds of a flat knitting machine, then the knitting of the body portion is allowed to proceed, while at the sleeve portion, the course ratio is changed suitably according to the length ratio from wristband to side and from wristband to shoulder. While both parts are formed in this way, stitch loops of the sleeve portion are moved by transfer so as to overlap the stitch loops positioned on the outermost side of the body portion adjacent thereto, thereby successively forming a shoulder line along the connection, and at the same time the fabric knitting operation is allowed to proceed.

In such conventional method, however, at the time of connecting the separately knitted fabrics together, the stitch loops of the outermost wales adjacent to each other are overlapped together by transfer. As a resulting, the stitch loops of the connecting portion are bent opposedly to each other and the beauty of the shoulder line formed is spoiled. Thus, although the labor-saving of the sewing work is attained and the productivity is improved, it is difficult to obtain a beautiful finished product.

OBJECT AND SUMMARY OF THE INVENTION

The present invention has been accomplished in view of the above-mentioned point and it is the object of the invention to obtain a beautiful finished fabric of high quality wherein stitch loops of a connecting portion are not bent opposedly to each other, and provide a method for producing such fabric.

According to one embodiment of the present invention, in order to solve the above-mentioned problem, there is provided a fabric wherein parts constituting an article of clothing are knitted separately, using a flat knitting machine having at least one pair of needle beds arranged opposedly in the front and rear such that a knitted part on one side of the needle bed may be moved and connected to a knitted part on the other side of the needle bed. Additionally, stitch loops located on the outermost portion of the knitted part on one side may be overlapped with the stitch loops of one of the second, third and fourth wales (measured from the outermost wale) of the knitted part on the other side.

In accordance with one embodiment of the present fabric connecting method, parts of an article of clothing may be knitted separately using a flat knitting machine having at least one pair of needle beds arranged opposedly in the front and rear. A first knitted part on one side of the needle bed may be moved to a second knitted part on the other side of the needle bed to overlap a stitch. More particularly, a stitch loop positioned on the outermost portion of the first knitted part which may be racked two to four needles in a predetermined direction may be overlapped with a stitch loop of one of the second to fourth wales (counted from the outermost wale) of the second knitted part. Additionally, yarn may be fed to the needles of the second knitted part, including the overlapped stitch, to perform fabric knitting, the overlapped stitch may be released from the needles, and these steps may be repeated to connect the knitted parts.

Thus, as a connecting line including the overlapped stitch loops may be positioned one to three wales inside the outermost wale of the knitted fabric and there may be a series of stitches formed by a single course adjacent to the outside of the knitted part, the stitch loops of the connecting line in the overlapped state are prevented from being bent and retain their shape. In the connecting portion, therefore, there is no sense of incongruity in appearance, and since stitches are not overlapped at the outermost wale, no bad influence is exerted on the stitch loop shape, that is, the appearance is not spoiled.

DETAILED DESCRIPTION OF PREFERRED EMBODIMENT

A knitting method according to a preferred embodiment of the present invention will now be described with reference to the accompanying drawings. In this embodiment there is shown a method for connecting two pieces of fabric which are used as clothing parts a body portion and a left-hand sleeve portion, using a flat knitting machine having a pair of needle beds constituting a front and a rear the rear needle bed being provided with a racking mechanism. According to this method, at the time of moving the sleeve portion to the body portion, the stitch loops positioned on the outermost side of the sleeve portion are overlapped with stitch loops located in the second wale position from the boundary side of the body portion adjacent thereto. An explanation will be given below using part of a related design (loop diagram shown in FIG. 2) and a related knitting diagram (block diagrams shown in FIGS. 3*a* to 3*h*). As to simultaneous knitting and connection of three pieces of clothing parts which are right- and left-side sleeve portions and a body portion, this processing will be omitted in the following description because it can be carried out easily by the application of this embodiment as necessary and also for convenience in explanation. Also as to the size (number of needles) of the body portion and that of the sleeve portion, they are reduced for the above reason.

Figure 1:
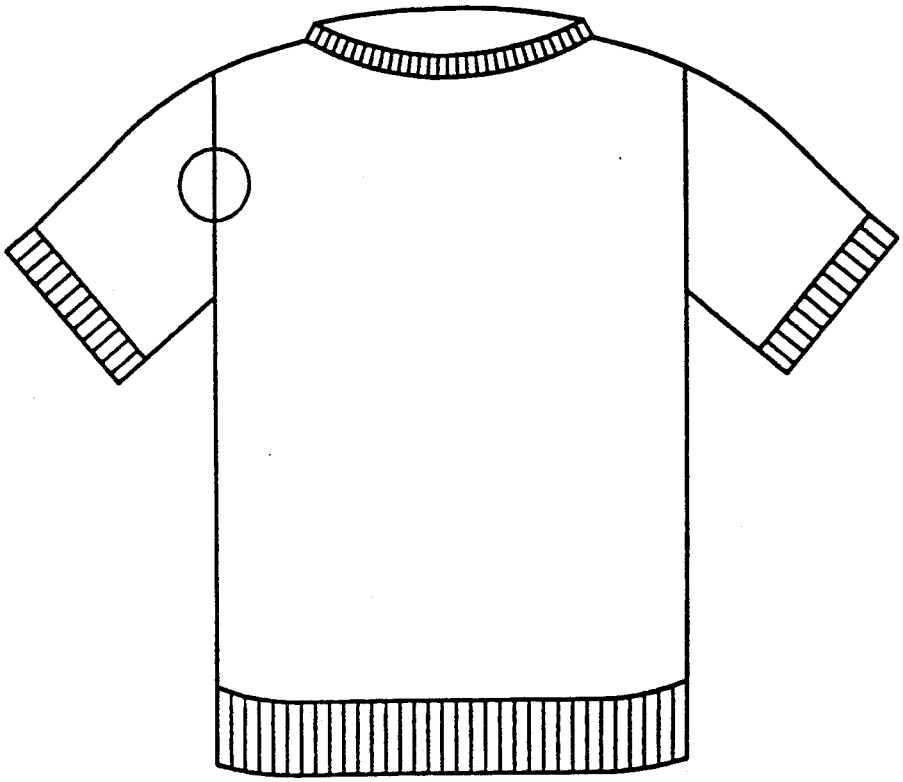
FIG. 1 illustrates an article of clothing according to an embodiment of the present invention.

FIG. 1 illustrates the construction of an article of clothing, and in FIGS. 3*a*–*h* there are shown needles ABC ... XYZ implanted in a front needle bed I and needles abc ... xyz implanted in a rear needle bed II. A sleeve portion is knitted with the needles ABC ... KLM of the front needle bed, while a body portion is knitted with the needles OPQ ... XYZ. By means of yarn feeders 100 and 200 the sleeve and body portions have already been subjected to set up and knitting of their principal portions according to a known method and reached an armpit portion, though not shown in the knitting diagram.

Figure 2:
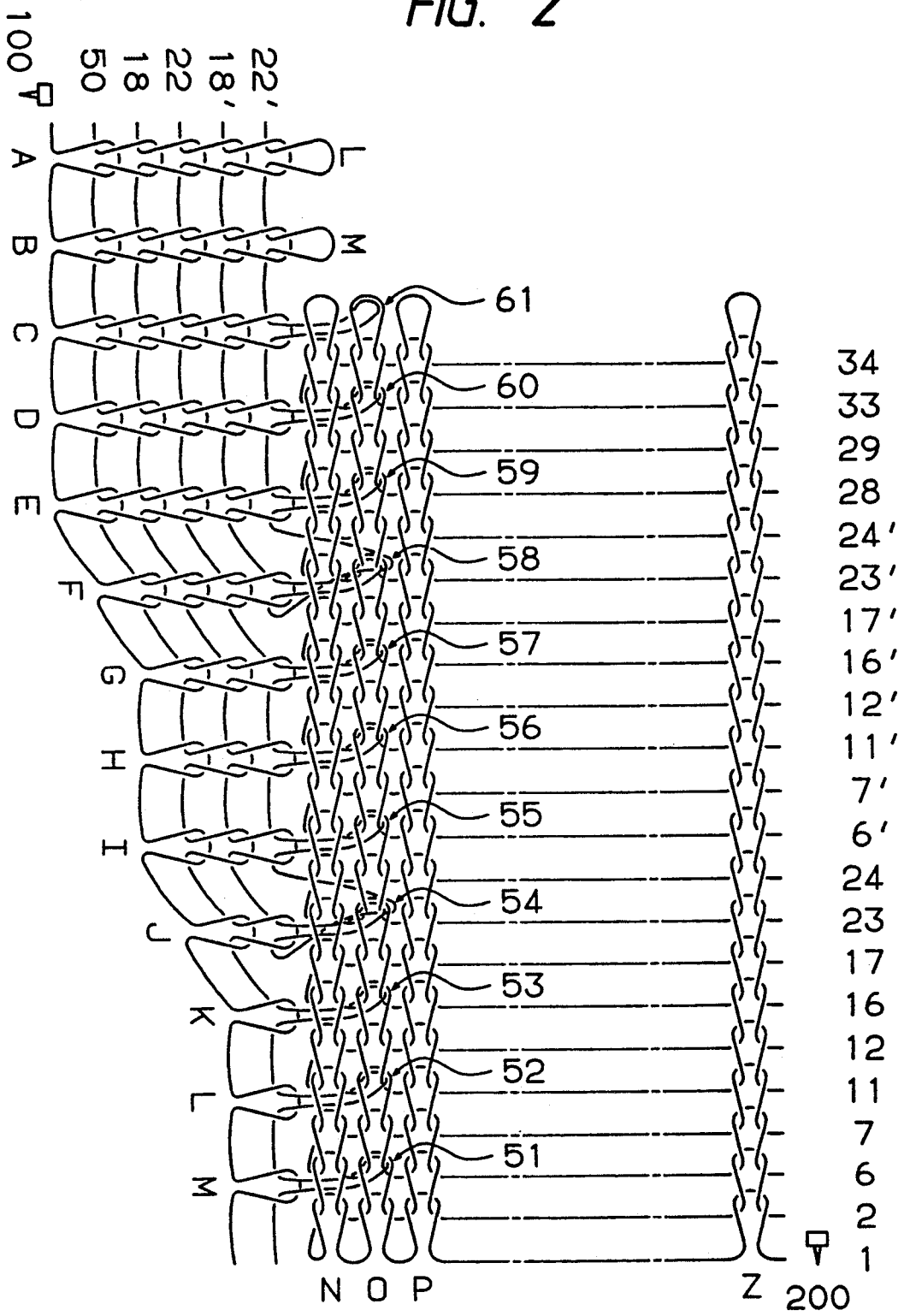
FIG. 2 is a loop diagram of a connection in accordance with one embodiment of the present invention.
Figure 3A:
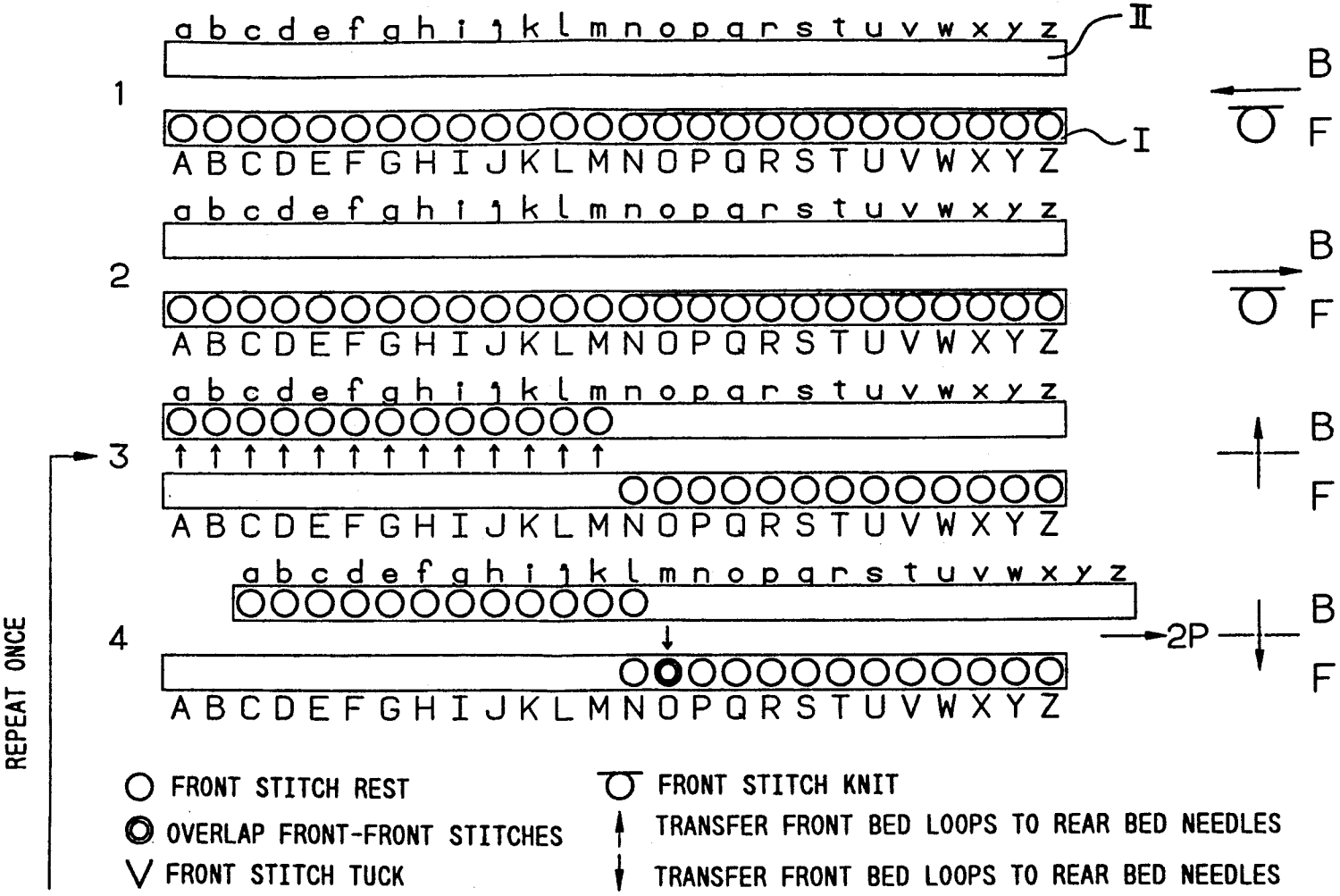
FIG. 3*a* to 3*h* are knitting diagrams of the connection.
Figure 3B:
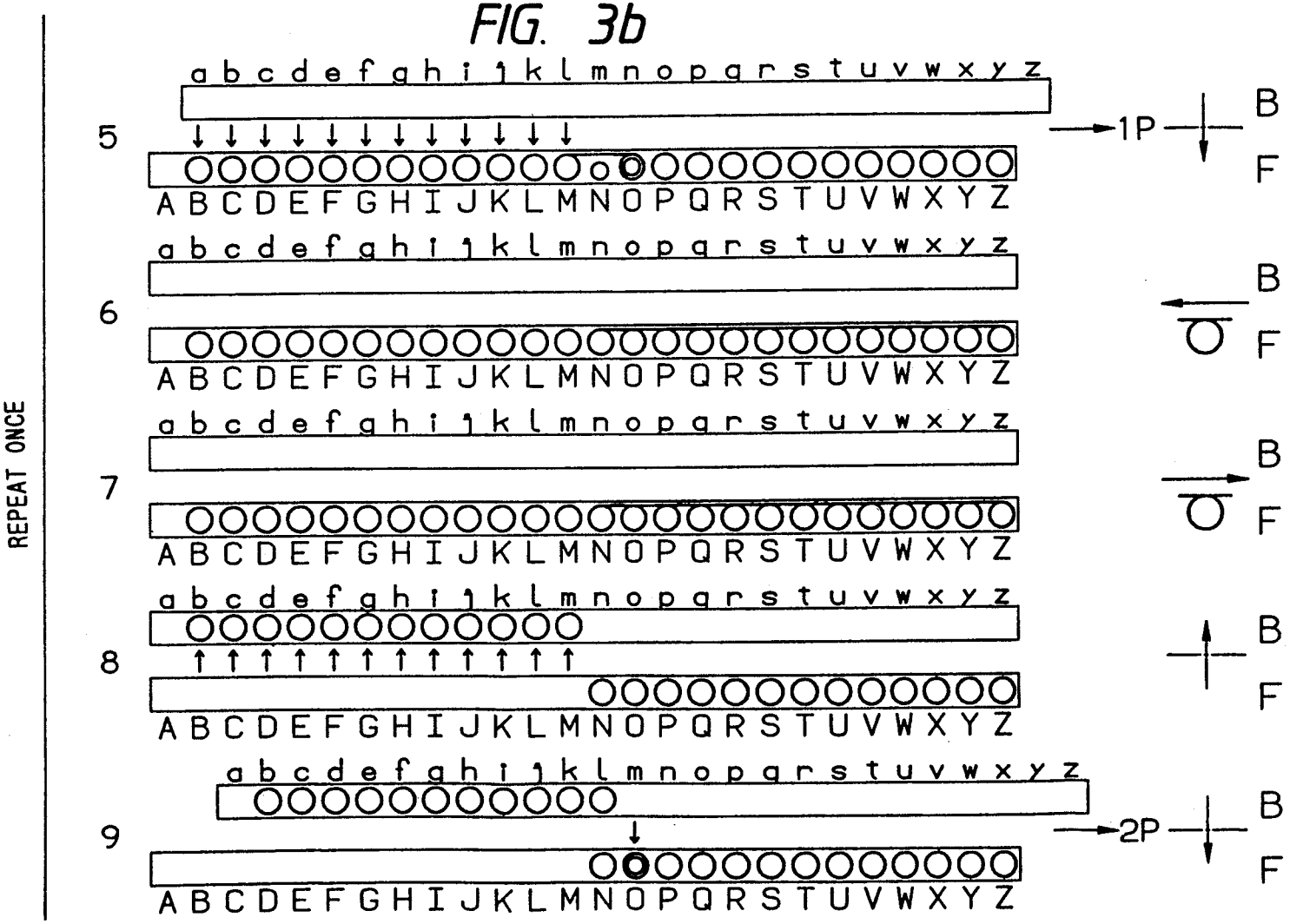
Figure 3C:
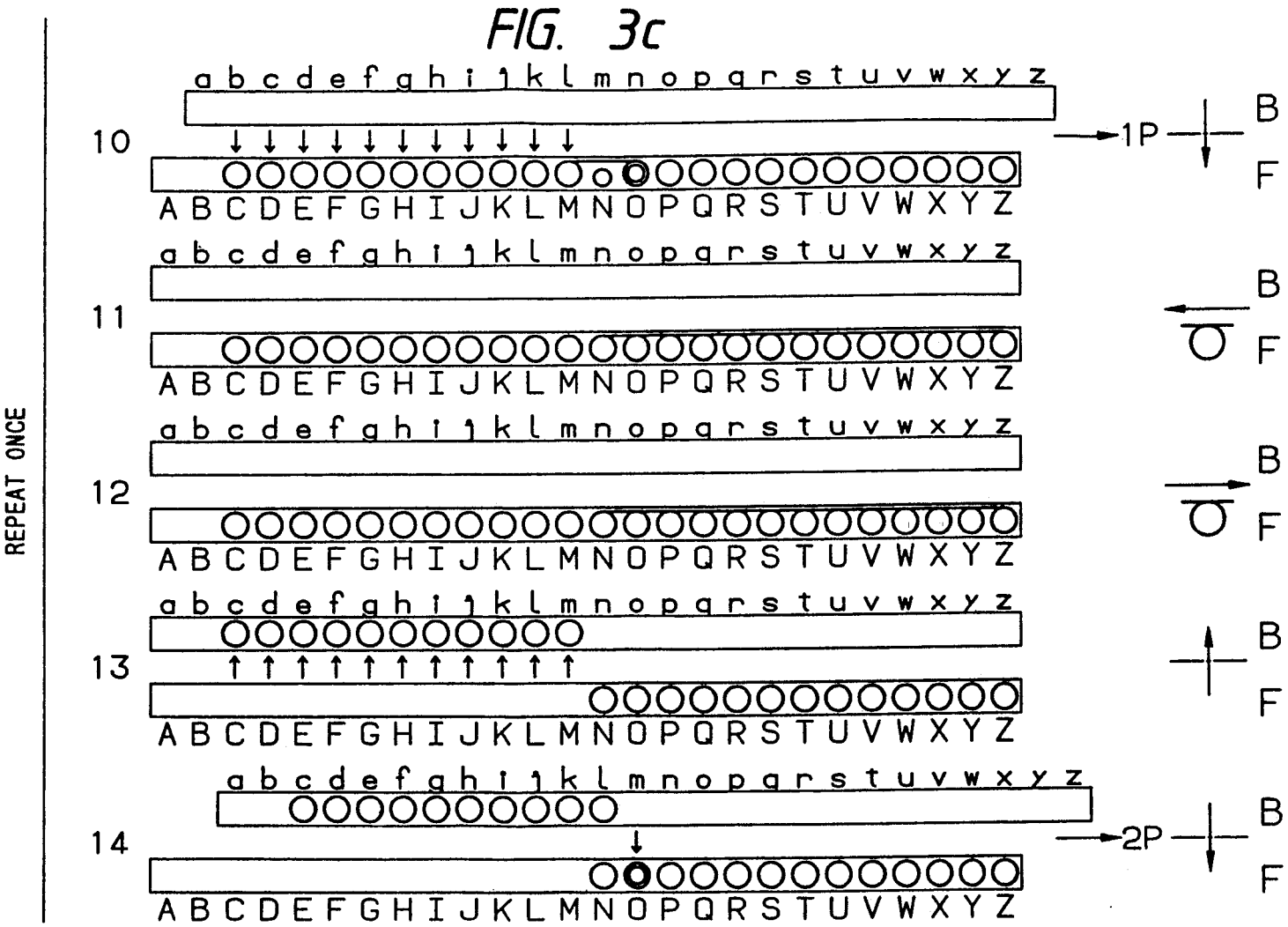
Figure 3D:
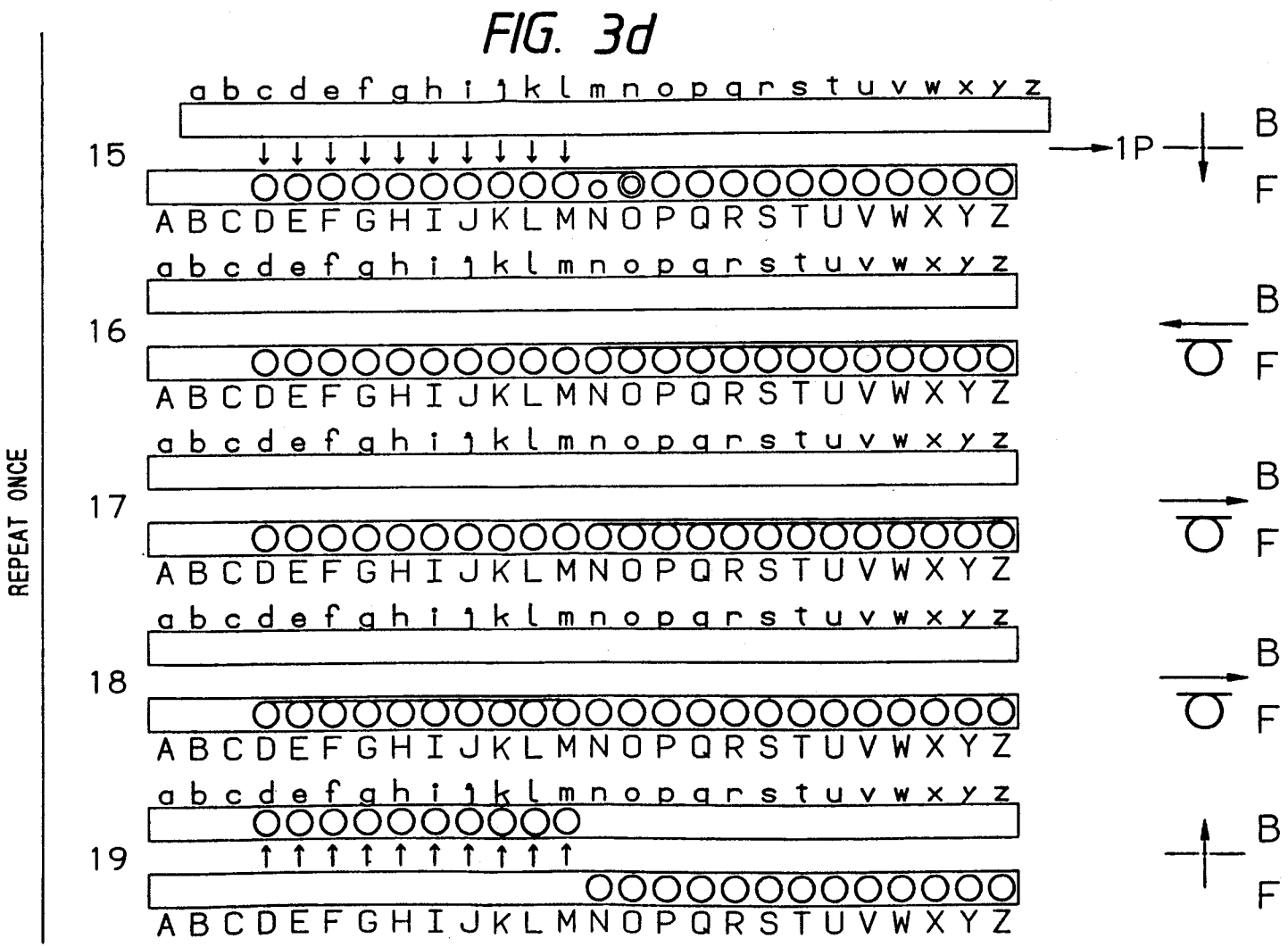
Figure 3E:
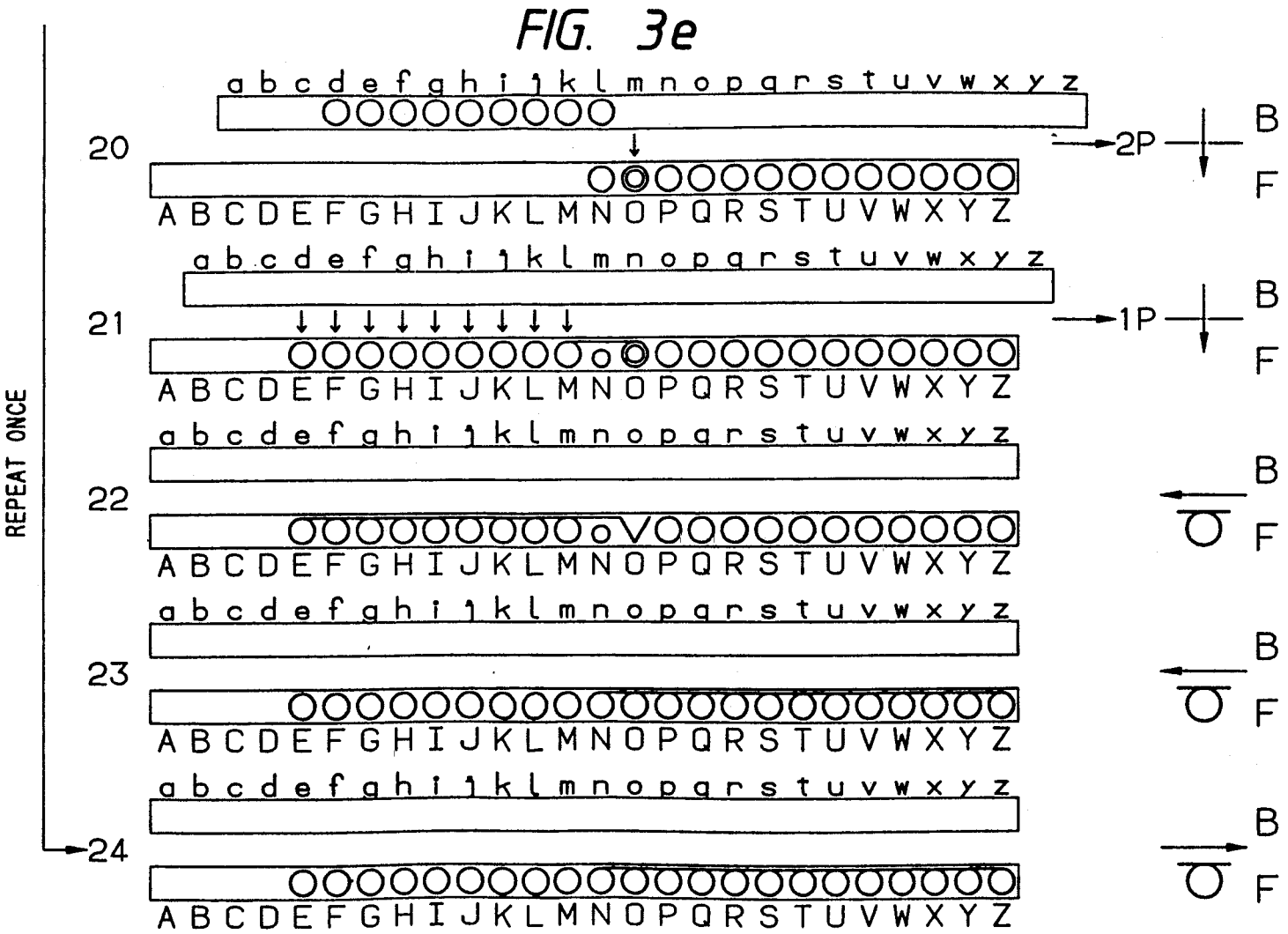
Figure 3F:
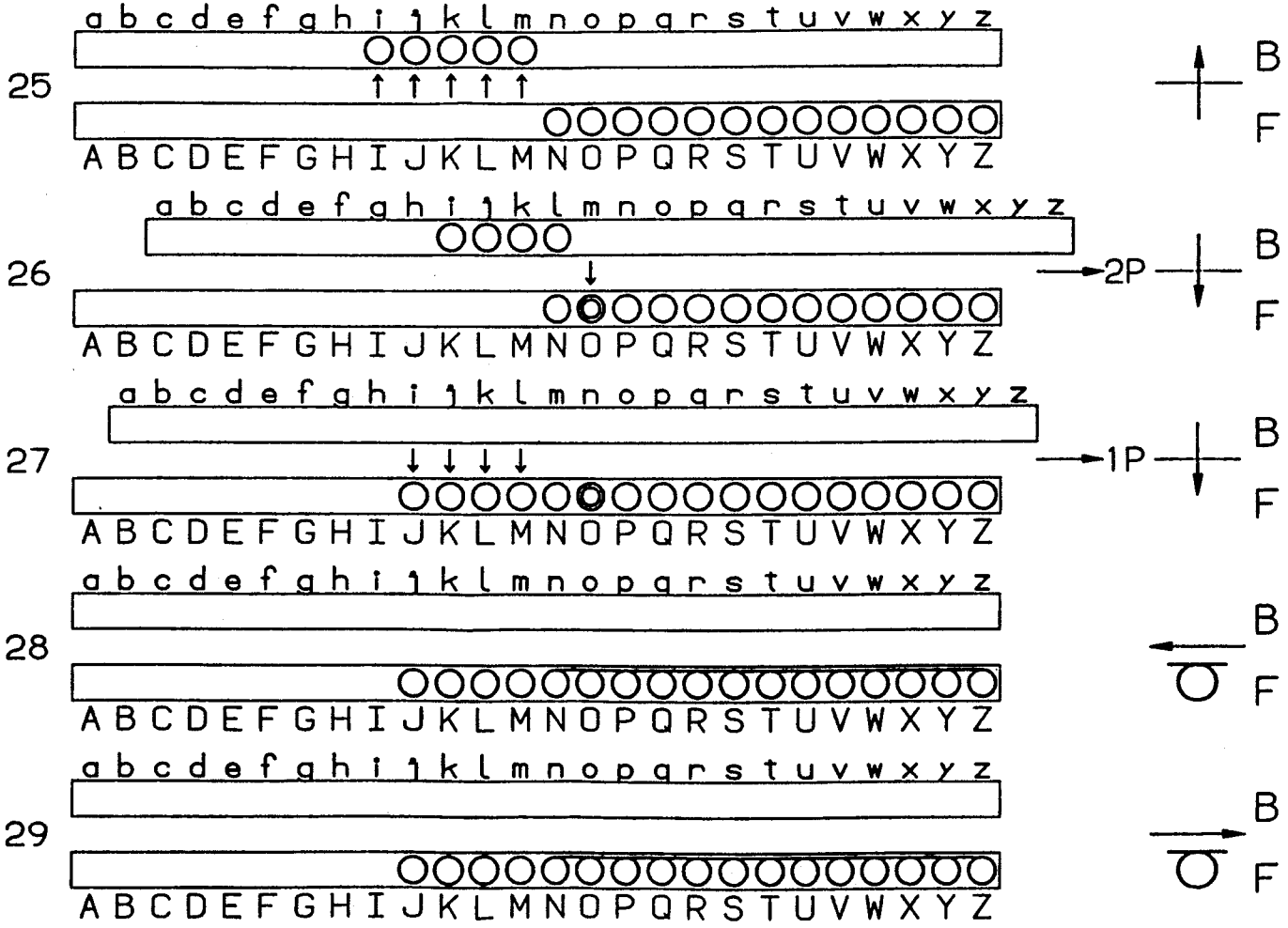
Figure 3G:
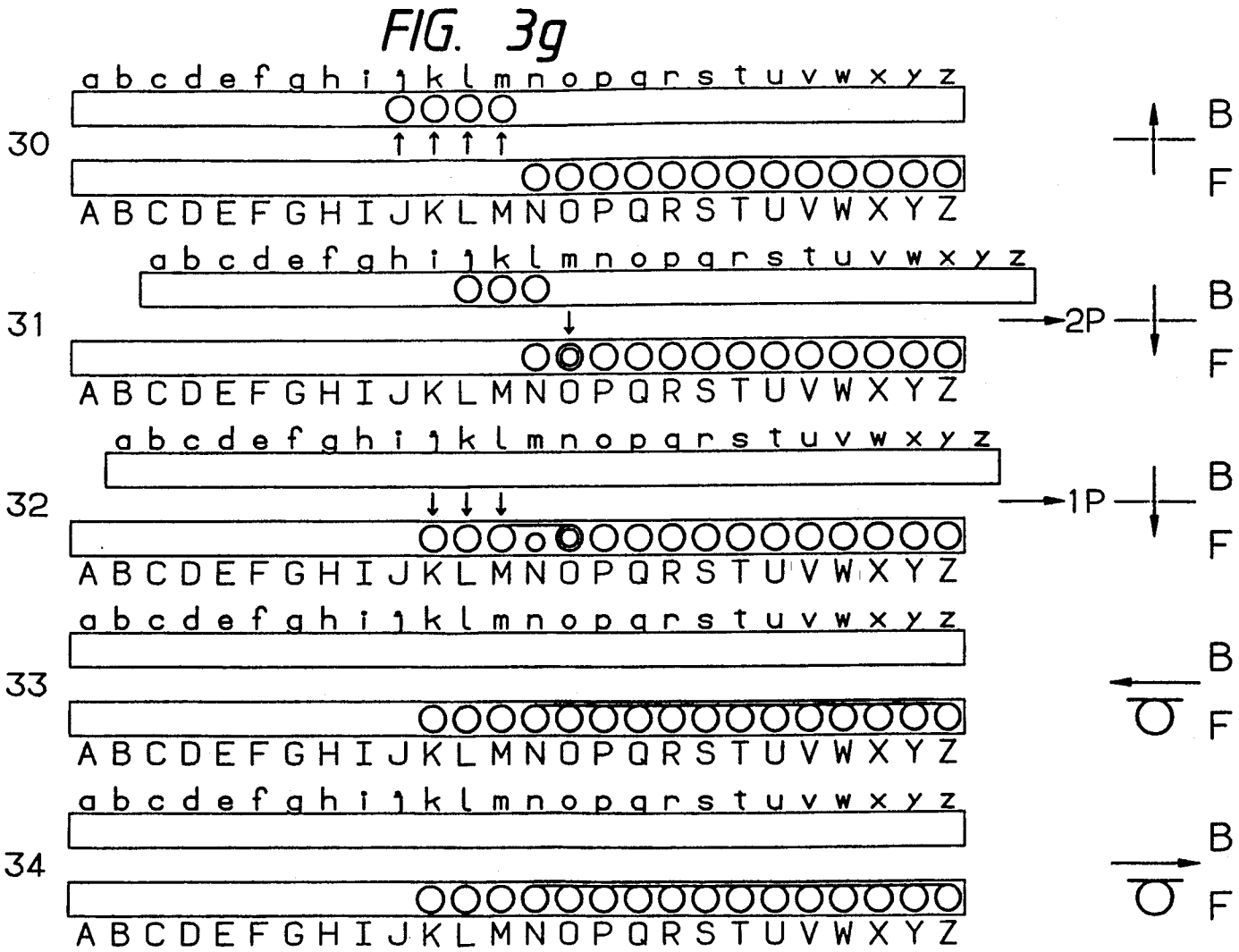
Figure 3H:
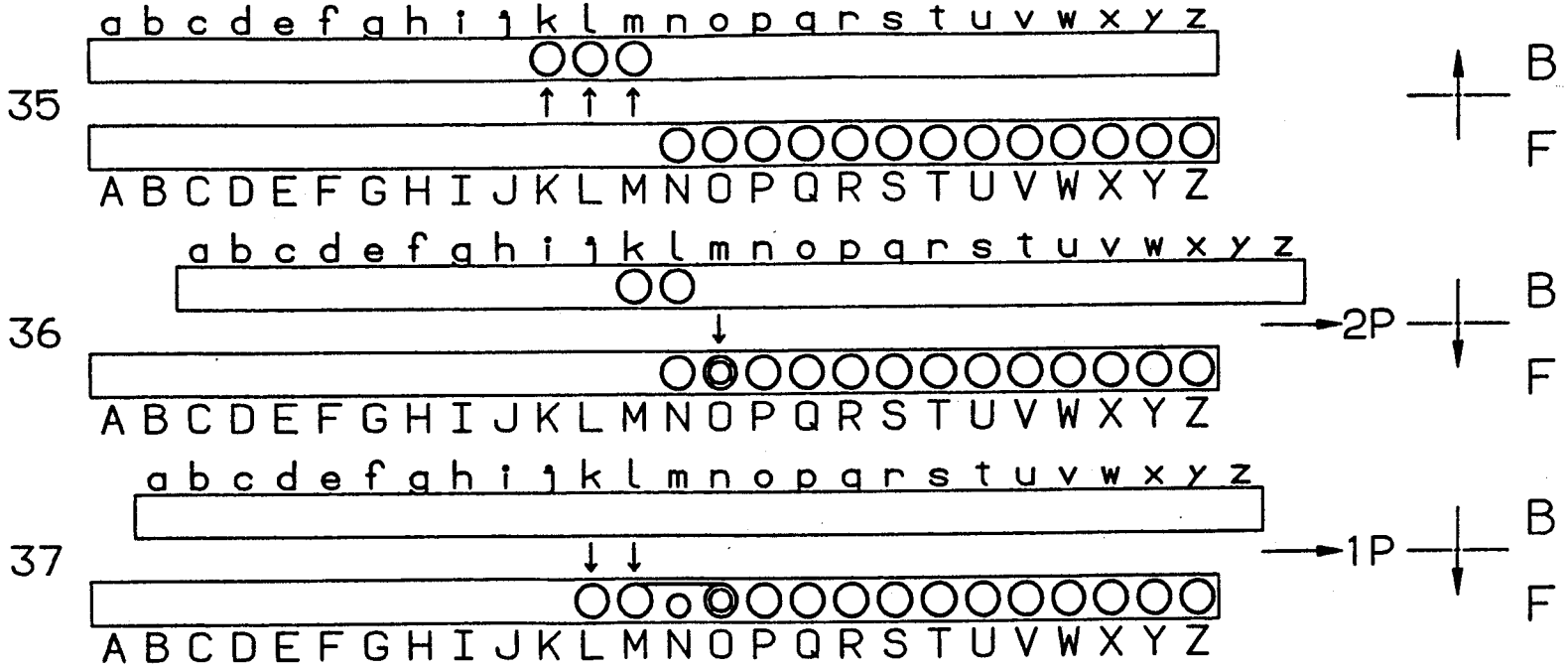

In blocks 1 and 2 shown in FIG. 3*a* yarn is fed to course knitting needles ZYX ... PON for the body portion which follows the armpit portion, by means of the yarn feeder 200, and after knitting a course 1 shown in FIG. 2 yarn is fed again to the needles NOP ... XYZ to knit a course 2. Then, the feeder returns to its original position.

In block 3, stitches of a course 50 retained by the needles ABC ... KLM of the sleeve portion are moved to the opposed needles abc ... klm of the rear needle bed. Then, in block 4 which follows, the rear needle bed is racked rightwards by two needles to move the stitch at needle m to needle 0 on the front needle bed to overlap stitches. The overlapped stitches are indicated at 51 in FIG. 2. Then, in block 5, the rear needle bed is racked to the left by one needle from the state of block 4; that is, racking is made rightward by one needle from a reference position in which needles ABC ... XYZ and abc ... xyz of the front and rear needle beds are opposed to each other, thereby causing the stitches at needles abc ... jkl to move to empty needles BCD ... KLM which are opposed thereto.

In blocks 6 and 7, like blocks 1 and 2, the knitting of the body portion is performed to form courses 6 and 7. In block 8, the stitches of the sleeve portion at needles BCD ... KLM are moved to needles bcd ... klm of the rear needle bed, then in block 9 which follows, the rear needle bed is racked rightward by two needles, thereby causing the stitch at needle m to move to needle O on the front needle bed and allowing stitches to overlap each other. The overlapped stitches are indicated at 52 in FIG. 2. Further, in block 10, racking is made rightward by one needle from the reference position to move the stitches at needle bcd ... jkl to empty needles CDE ... KLM which are opposed thereto. In blocks 11 and 12, there is performed knitting of the body portion to form courses 11 and 12. In block 13, the stitches of the sleeve portion at needles CDE ... KLM are moved to the needles cde ... klm of the rear needle bed, then in block 14 which follows, the rear needle bed is racked rightward by two needles to move the stitch at needle m to needle O on the front needle bed, thereby overlapping stitches. The overlapped stitches are indicated at 53 in FIG. 2. In block 15, racking is made rightward by one needle from the reference position to move the stitches at needles cde ... jkl to empty needles DEF KLM which are opposed thereto.

In blocks 16 and 17 there is performed knitting of the body portion to form courses 16 and 17.

Then, in block 18, the yarn feeder 100 is moved from left to right by means of a carriage (not shown) to feed yarn to needles DEF ... KLM, thereby forming a course 18 of the sleeve portion, whereupon it stops. In block 19, the loops retained by the needles DEF ... KLM are moved to needles def ... klm of the rear needle bed. In block 20, the rear needle bed is racked rightward by two needles to move the stitch at needle m to needle 0 on the front needle bed, thereby overlapping stitches, as indicated at 54 in FIG. 2. Then, in block 21, racking is made rightward by one needle from the reference position to move the stitches at needles def ... jkl to empty needles EFG ... KLM which are opposed thereto.

In block 22, yarn is fed to needles MLK ... GFE by the yarn feeder 100 to form a course 22 of the sleeve portion, and at the same time a tuck joint is applied to the loop of the body portion retained by the needle 0 to prevent the formation of a hole in the boundary between the sleeve portion and the body portion.

In blocks 23 and 24, yarn is fed to needles NOP ... XYZ to perform knitting of the body portion, thereby forming courses 23 and 24.

By repeating knitting operations similar to those in the above blocks 3 to 24 the sleeve portion and the body portion are connected together while the former is moved to the latter to form overlapped stitches 55, 56, 57 and 58 which are shown in FIG. 2.

In block 25, the loops retained by the needles IJKLM are moved to the needles ijklm of the rear needle bed. In block 26, the rear needle bed is racked rightward by two needles to move the stitch at needle m to needle O on the front needle bed, thereby overlapping stitches as indicated at 59 in FIG. 2. Then, in block 27, racking is made rightward by one needle from the reference position to move the stitches at needles ijkl to emtpy needles JKLM which are opposed thereto. In blocks 28 and 29 there is performed knitting of the body portion to form courses 28 and 29. In block 30, the stitches of the sleeve portion at needles JKLM are moved to the needles jklm on the rear needle bed, and in block 31 which follows, the rear needle bed is racked rightward by two needles to move the stitch at needle m to needle O on the front needle bed, thereby overlapping stitches, as indicated at 60 in FIG. 2. Then, in block 32, racking is made rightward by one needle from the reference position to move the stitches at needles jkl to empty needles KLM which are opposed thereto.

In blocks 33 and 34, there is performed knitting of the body portion to form courses 33 and 34. In block 35, the stitches of the sleeve portion at needles KLM are moved to needles klm on the rear needle bed, and in block 36 which follows, the rear needle bed is racked rightward by two needles to move the stitch at needle m to needle 0 on the front needle bed to overlap stitches, as indicated at 61 in FIG. 2. Then, in block 37, racking is made rightward by two needles from the reference position to move the stitches at needle kl to empty needles LM which are opposed thereto.

In this way the connection of the sleeve and body portions is continued (not shown), whereby there is formed a shoulder line having a beautiful appearance. Further, by continuing the body portion knitting operation (not shown) there is formed a fabric which permits the omission of the sewing process to a great extent.

In the above embodiment, when the sleeve portion is moved to the body portion, the endmost stitch loops of the sleeve portion are overlapped with the stitch loops of the second wale from the adjacent side of the body portion which is opposed thereto. But in the case where the endmost stitch loops are to be overlapped with the stitch loops of the third to fourth wales, it is not always required to apply a tuck joint to the body portion at the time of knitting the sleeve portion, and even without forming a close connection, the hole formed therein is covered and hidden by the loops of the body portion overlying the hole, so is not exposed to the product surface.

The knitting method of the present invention is not limited to the sleeve-body connection in the above embodiment, but is applicable to conventional fabric connecting methods. Further, although in the above embodiment there is used a knitting machine having a pair of needle beds in front and in the rear, it goes without saying that the present invention can be practised even by the use of a knitting machine having two or more pairs of needle beds. In this case, it becomes possible to knit the parts of a clothing article, including sleeve and body portions, in a cylindrical form and so the sewing step after knitting can be omitted to a greater extent. Such a modification may be made within the scope not departing from the gist of the present invention.

As is apparent from the above embodiment, since the wale in the connection is positioned inside, the external shape is retained by the action of adjacent stitches and hence the appearance is not impaired. Besides, since the stitches of the wale located outside the connection are placed in a free state, the beauty of a shoulder line formed is not spoiled and there is obtained a fabric whose finishing is neat.

Further, since the stitches located outside the connection and assuming such free state are curled inside due to properties of the fabric itself, there can be formed an elegant fabric having a three-dimensional appearance in the connection, including a fabric located in a lower position such as a sleeve portion, a fabric located in an upper position such as a body portion, and an end wale fabric of the body portion positioned in a form having depth between the upper and lower portions.

What is claimed is:

1. A fabric, comprising:

first and second knitted parts formed separately on respective first and second opposedly arranged beds of a flat knitting machine, the first knitted part defining an outermost portion, the second knitted part defining at least first and second wales, the first wale defining an outermost wale, and a connecting line connecting the first and second knitted parts, the connecting line including an overlapped stitch loop positioned inside the outermost wale by at least one wale, the overlapped stitch loop defining at least one stitch loop from the first part overlapped with at least one stitch loop from the second wale.

2. The fabric of claim 1, wherein the second knitted part defines a third wale and the at least one stitch loop from the first part is overlapped with at least one stitch loop from the third wale.

3. The fabric of claim 1, wherein the second knitted part defines a fourth wale and the at least one stitch loop from the first part is overlapped with at least one stitch loop from the fourth wale.

4. A method of connecting first and second separately knitted parts using a flat knitting machine, the flat knitting machine defining first and second opposedly arranged needle beds for respectively knitting the first and second parts, the first part defining an outermost portion and the second part defining at least first, second, third and fourth wales, the first wale defining an outermost wale, the method comprising the steps of:

racking the first needle bed at least two needles in a predetermined direction, moving a stitch loop of the outermost portion of the first part onto a stitch loop of one of the second, third and fourth wales of the second part to form an overlapped stitch, feeding yarn to needles of the second needle bed, including the overlapped stitch, to perform fabric knitting, releasing the overlapped stitch from the needles, and repeating the above steps, wherein a connecting line including the overlapped stitch loops is formed and positioned inside the outermost wale by at least one wale.

5. The method of claim 4, wherein the first needle bed is racked three needles in the predetermined direction and the connecting line is positioned inside the outermost wale by two wales.

6. The method of claim 4, wherein the first needle bed is racked four needles in the predetermined direction and the connecting line is positioned inside the outermost wale by three wales.

7. A method of connecting first and second separately knitted parts using a flat knitting machine, the flat knitting machine defining first and second opposedly arranged needle beds for respectively knitting the first and second parts, the first part defining an outermost portion and the second part defining at least first and second wales, the first wale defining an outermost wale, the method comprising the steps of:

racking the first needle bed at least two needles in a predetermined direction, moving a stitch loop of the outermost portion of the first part onto a stitch loop of the second wale of the second part to form an overlapped stitch, feeding yarn to needles of the second needle bed, including the overlapped stitch, to perform fabric knitting, and releasing the overlapped stitch from the needles.

8. The method of claim 7, wherein the second part defines a third wale, the first needle bed is racked three needles in the predetermined direction, and the stitch loop of the outermost portion of the first part is moved onto the stitch loop of the third wale of the second part.

9. The method of claim 8, wherein the second part defines a fourth wale, the first needle bed is racked four needles in the predetermined direction, and the stitch loop of the outermost portion of the first part is moved onto the stitch loop of the fourth wale of the second part.

* * * * *